US005846341A

United States Patent [19]

Shemetov et al.

[11] Patent Number: 5,846,341

[45] Date of Patent: Dec. 8, 1998

[54] METHOD OF CARRYING OUT DIAGNOSTICS ON A PROCESS FOR THE THERMO-CHEMICAL TREATMENT OF STEELS AND ALLOYS IN A GLOW DISCHARGE AND A DEVICE FOR CARRYING OUT THE SAID METHOD

[76] Inventors: Valery Vasilyevich Shemetov, Odintsovski1 rajon. p/o shikhovo d. 3, kv. 4, Moskovskava obl. 143092; Nikolai Mikhailovich Ryzhov, Stavropplskava ul., d. 28, kor. 2, kv. 52, 109386 Moscow; Andrei Evgenievich Smirnov, Shorematyevaskaya ul., d. 25, kv. 136, 127521 Moscow, all of Russian Federation

[21] Appl. No.: 507,452

[22] PCT Filed: May 10, 1994

[86] PCT No.: PCT/RU94/00100

§ 371 Date: Aug. 9, 1996

§ 102(e) Date: Aug. 9, 1996

[87] PCT Pub. No.: WO95/17101

PCT Pub. Date: Jun. 29, 1995

[30] Foreign Application Priority Data

Dec. 20, 1993 [RU] Russian Federation ..... 93056024

[51] Int. Cl.[6] ..... C21D 1/09; C23C 8/20; C23C 8/24

[52] U.S. Cl. ..... 148/216; 148/222; 266/78; 266/80; 266/90; 427/8; 427/533; 427/517; 204/192.16; 324/464; 324/466; 324/468

[58] Field of Search ..... 148/216, 222; 266/78, 80, 90; 427/8, 10, 533, 535, 517; 204/192.3, 192.16; 324/464, 466, 408

[56] References Cited

U.S. PATENT DOCUMENTS

| | | | |
|---|---|---|---|
| 4,108,693 | 8/1978 | L'ttermite et al. | 148/216 |
| 4,445,945 | 5/1984 | Schwalm | 148/216 |
| 4,472,209 | 9/1984 | Langerich et al. | 148/216 |
| 5,650,201 | 7/1997 | Tompa | 427/533 |
| 5,661,115 | 8/1997 | Sandhu | 427/533 |

FOREIGN PATENT DOCUMENTS

| | | |
|---|---|---|
| 0 183 230 | of 1985 | European Pat. Off. . |
| 2 600 082 | of 1987 | France . |
| 29 23 285 | of 1981 | Germany . |
| 1 198 132A | 12/1985 | U.S.S.R. . |
| 1 461 083 | 1/1977 | United Kingdom . |
| 2 060 711 | 5/1981 | United Kingdom . |

OTHER PUBLICATIONS

Decision to grant Russian Federation patent on priority application No. 93–056024/02 and English translation, 1985.

Proceedings of 7*th*International Congress on Heat Treatment of Materials, Dec. 11–14 of 1990, Moscow.

USSR Author's Certificate No. 769410, Sensor of Carbon Potential, Jan. 24, 1978.

USSR Author's Certificate No. SU 1008278 A, Multipositional Sensor for Active Control of Heat Treatment Hardening of Steels and Alloy.

*Primary Examiner*—Deborah Yee
*Attorney, Agent, or Firm*—Brinks Hofer Gilson & Lione

[57] ABSTRACT

The proposed method of carrying out diagnostics on a process for the thermo-chemical treatment of steels and alloys in a glow discharge involves monitoring the ionization characteristics of the atmosphere as revealed by the intensity of the electromagnetic radiation in various frequency intervals. The proposed device for carrying out the method in question comprises a primary converter (1) in the form of an electromagnetic radiation emitter unit and contains filtering elements (5) mounted in such a way that they can be positioned in the radiation zone in front of the receiver (6) on a rotating disk (4). The disk (4) is provided with a rotation drive (7) for positioning the elements (5).

12 Claims, 3 Drawing Sheets

Figure 1:
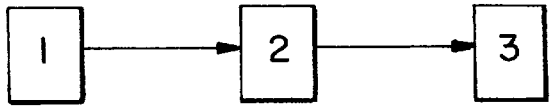

METHOD OF CARRYING OUT DIAGNOSTICS ON A PROCESS FOR THE THERMO-CHEMICAL TREATMENT OF STEELS AND ALLOYS IN A GLOW DISCHARGE AND A DEVICE FOR CARRYING OUT THE SAID METHOD

THE FIELD OF TECHNOLOGY

The invention belongs to the field of metallurgy, in particular, to the field of surface heat treatment of steels and alloys in glow discharge and can be used in mechanical engineering for upgrading of surface hardening in carburizing, nitrocarburizing and nitriding of steels and alloys in glow discharge.

THE STATE-OF-THE-ART

Glow discharge has a characteristic specter of electromagnetic radiation. An intensity distribution in this specter depends on a chemical composition of the atmosphere where the discharge is ignited. When glow discharge is used for purposes of surface heat treatment of steels and alloys a radiation intensity is related in a unique fashion not only with the initial atmosphere composition but with complex physical and chemical processes occurring on and near the surface being treated as well. The regular relations which display themselves in electromagnetic radiation emitted in particular frequency regions are determined by concentrations of carbon- and nitrogen-containing particles and some other particles which are forming during ion heat treatment and depend upon the initial atmosphere composition, an area and a state of the surface being treated. These relations are very complex and insufficiently studied yet.

At present there is no direct way to determine a saturating ability of the ionized atmosphere during carburizing, nitrocarburizing or nitriding. Direct ways of diagnostics for phase transformations occurring on the surface being saturated during ion heat treatment are also unknown.

There is a sensor for active monitoring of steels and alloys heat treatment hardening which is designed to implement the way of heat treatment monitoring based on a known dependence of a contact potential difference in a point where a probing electrode touches the surface being saturated upon a chemical and phase composition of the materials brought into the contact. (Author's Certificate of the USSR 1008278, C23C 11/10, Bulletin of Inventions, -1983, #12). However, results obtained with the above named device suffer of noticeable measuring errors due to the following causes. First, the sensor surface is saturated in conditions which differ from that for a load of machine parts; second, the monitoring is performed at some distance from the surface being saturated; third, an output sensor signal includes integrated information about concentrations of all saturating elements and phase transformations in the diffuse layer; the device fails to separate these data.

This method does not provide possibility to determine a saturating ability of the atmosphere characterized by a content of active components in it and to fix a moment of the excessive phase development on the surface of the parts being treated.

There is another device designed to determine specific expenditure of the saturating gas in ion carburizing installations. (Author's Certificate of the USSR 769410, G01 N 7/10, Bulletin of Inventions, -1980, #37). Results obtained with the above named device suffer of noticeable measuring errors because they contain information on total amount of carbon absorbed by the surface during the whole saturating cycle. Besides, when the metal is saturated with carbon and nitrogen simultaneously this method fails to determine a saturating ability of each of these elements separately. This device also can not monitor phase transformations on the surface of the machine parts being treated.

The following diagnostics method for ion heat treatment of steels and alloys and the device for its realization are the closest to the applied inventions. This method (B. Edenhofer, Plasma carburizing and high pressure gas quenching in vacuum furnaces, 7th International Congress on Heat Treatment of Materials, -M., -1990, V. 1, pp. 103–112) consists in plasma parameters monitoring with subsequent estimating of a plasma saturating ability. The device realizing this method is designed as an electric current density sensor including connected one after another an instrument transducer, an electric signal convertor and a function generator.

The method and the device for its realization have serious drawbacks which result in a rather high level of errors in determining of carbon- and nitrogen-containing particles flows. The errors are due to the fact that the method determines a total number of ionized particles instead of detecting chemically active carbon-containing and nitrogen-containing components of the ionized atmosphere. Also the method can not detect a moment of the excessive phase (carbides, nitrocarbides) formation and soot deposition on the metal surface during a treatment cycle.

Besides, in conditions of low ionization this method fails to achieve a reasonable accuracy because in this case a leading part in heat treatment belongs to the excited neutral particles which can not be detected by the described method.

THE INVENTION DESCRIPTION

The method of carrying out diagnostics on a process for the thermo-chemical treatment of steels and alloys in a glow discharge and the device for carrying out the said method applied as the invention are based on emission spectra diagnostics.

Saturation in glow discharge runs in a highly activated medium with no thermodynamic equilibrium. Transformation reactions of atmosphere components in glow discharge are shifted to the direction of particles dissociation. That is why saturation in ion heat treatment can run up to formation of a solid crust of excessive phases on the metal surface and in carburizing (nitrocarburizing) it often completes with soot deposition on the metal surface.

In these conditions monitoring of excessive phase formation and soot deposition is very urgent. Formation of alloyed carbides (nitrocarbides) in low-alloyed steels results in formation of a carbide mesh, decrease of hardening capacity and fatigue resistance.

Spectral diagnostics allows to measure simultaneously different parameters of the ionized atmosphere defined by an atmosphere composition and affecting in a unique fashion the heat treatment of steels and alloys in glow discharge.

Exploitation of the applied diagnostics method and the device implementing this method provides higher accuracy for determination of technological atmosphere carburizing/nitriding ability in carburizing, nitriding and nitrocarburizing compared to all now known methods. It also provides higher reliability in determination of the moment when the excessive carbide (nitrocarbide) phase begins to develop, and the moment of soot deposition during carburizing or nitrocarburizing.

Exploitation of the invention also provides possibility to decrease spread in values of carbon and nitrogen concentrations along a diffuse layer depth down to +0.05% for carbon and +0.05% for nitrogen and to upgrade the treatment quality due to usage of treatment preventing insufficient surface saturation and, when low-alloyed steels are concerned, due to carburizing without excessive phase formation. In addition, the invention exploitation simplifies treatment cycle design and provides possibility to use the designed cycles for work loads of different areas and to transfer these cycles to other types of heat treatment installations.

Achievement of the above mentioned results is provided due to the fact that in the diagnostics method for heat treatment of steels and alloys in glow discharge consisting in monitoring of plasma characteristics with subsequent estimation of the process parameters, electromagnetic radiation is used as plasma characteristics. This monitoring is implemented though extracting of radiation corresponding to a number of active components and to a total number of particles in the ionized atmosphere, and subsequent conversion of intensities of radiation extracted from certain electromagnetic regions into electric signals. Process parameters evaluation is performed according to the quantity of active plasma components by comparing corresponding electric signals with one chosen as a reference signal which corresponds to the total number of plasma particles. To simplify evaluation of parameters of the ionized atmosphere, comparison of corresponding electric signals with the reference signal is made by dividing each of them by the reference signal.

Parameters used to describe the plasma state for diagnostics of heat treatment of steels and alloys in glow discharge can be different. In particular, to estimate carburizing ability of the working atmosphere radiation of carbon-containing particles is used as a plasma state parameter which depends on a quantity of these particles.

Nitriding ability of the working atmosphere is another plasma state parameter which depends on a quantity of active nitrogen-containing particles.

Electromagnetic radiation of particles of the metal being saturated is used as radiation of the active components to monitor carbide (nitrocarbide) phase formation during heat treatment of steels and alloys. The moment of formation of the excessive carbide (nitrocarbide) phase on the surface of the treated steel or alloy is detected when a quality of the metal particles achieves a given threshold value.

Particles of soot carbon are used as active components to monitor soot deposition. The moment of soot deposition on the metal surface is detected when their quantity achieves some given threshold value.

According to a chemical composition of the ionized atmosphere during heat treatment of steels and alloys boundary values of particular electromagnetic radiation frequency regions are set to constant or varying during diagnostics values and these frequency boundary values are determined in the diagnostics process.

Achievement of results expected due to exploitation of the device for heat treatment diagnostics is provided by its construction which is as the following. The device includes the instrument transducer connected through the electric signal converter to the function generator. The instrument transducer is made as an electromagnetic radiation filtering module to extract radiation both from active atmosphere components and from a total number of atmosphere particles and the electromagnetic radiation receiver. The electromagnetic radiation filtering module is designed as a set of filtering elements which can be positioned one after another in the region of electromagnetic radiation being received in front of the electromagnetic radiation receiver.

Practical implementation of the function generator may vary for different versions of the device.

In one of such versions designed to monitor only one process parameter, the function generator is made as a logarithmic amplifier, a module for detecting an amplitude-modulated signal component, a demodulator-converter and an indicator and an emergency signal module. When it takes place, the inputs of the emergency signal module and of the logarithmic amplifier designed to be connected to the output of the electric signal converter are connected to each other. The module for extracting electromagnetic radiation both from the atmosphere active components and from a total number of atmosphere particles is made as a disc with filtering elements set radially in it, a disc rotating driver and a filtering elements positioning module. The filtering elements positioning module is made as a filtering element position sensor, a synchronizer and a program module connected one after another. The program module output is connected to the disk rotating driver.

In another version of the device designed for simultaneous monitoring different characteristics of the ionized atmosphere this goal is provided by filtering elements positioning module and a program module. A function generator is made as a memory module, a division module and an indicator connected successively and a synchronizing pulse generator and an emergency signal module. Inputs of the emergency signal module and the synchronizing pulse generator, and the information input of the memory module, and the dividend input of the division module are connected to the output of the electric signal converter and the control input of the memory module is connected to the filtering elements positioning module. The filtering elements positioning module through the program module is connected to the module for filtering electromagnetic radiation both from the atmosphere active components and from a total number of atmosphere particles. The indicator inputs are connected correspondingly to the control input of the memory module and to the output of the synchronizing pulse generator.

BRIEF DESCRIPTION OF SKETCHES

The invention essence is made clear by the sketches. The function diagram of the device for diagnostics of heat treatment of steels and alloys in glow discharge realizing the corresponding method is shown on the FIG. 1.

Figure 2:
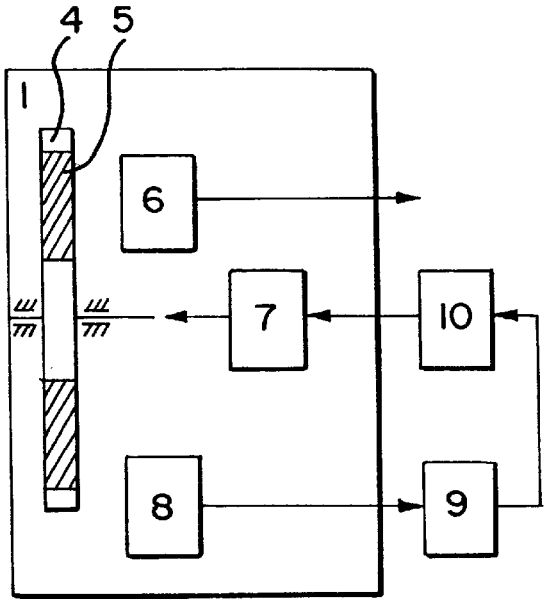

The device with possible modification of the module for extracting electromagnetic radiation both from the atmosphere active components and from a total number of atmosphere particles, the filtering elements positioning module together with the program module and modifications of the function generator are shown on the FIG. 2, 3, 4.

Figure 5:
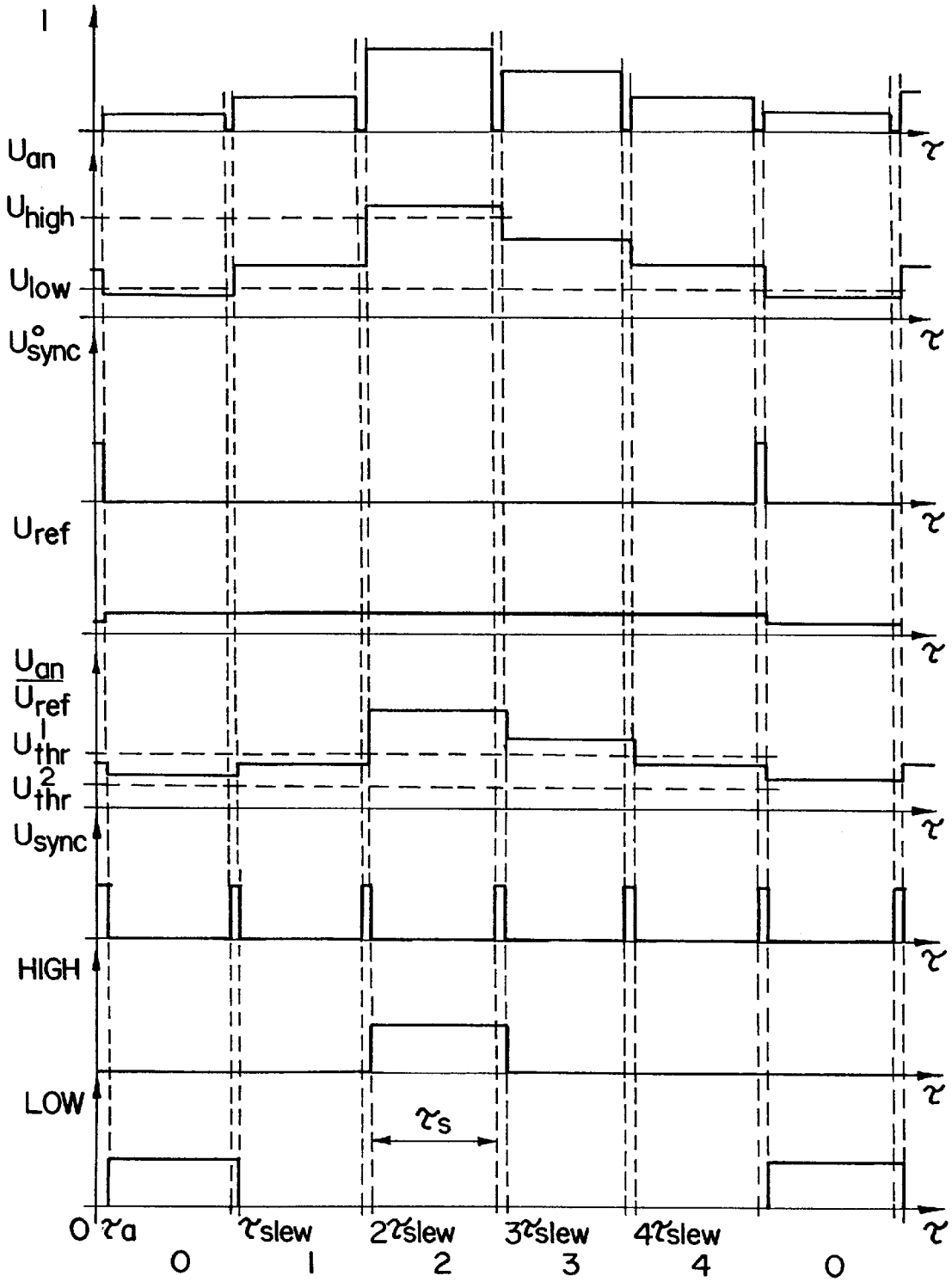

The time diagrams are shown on the FIG. 5.

Figure 6A:
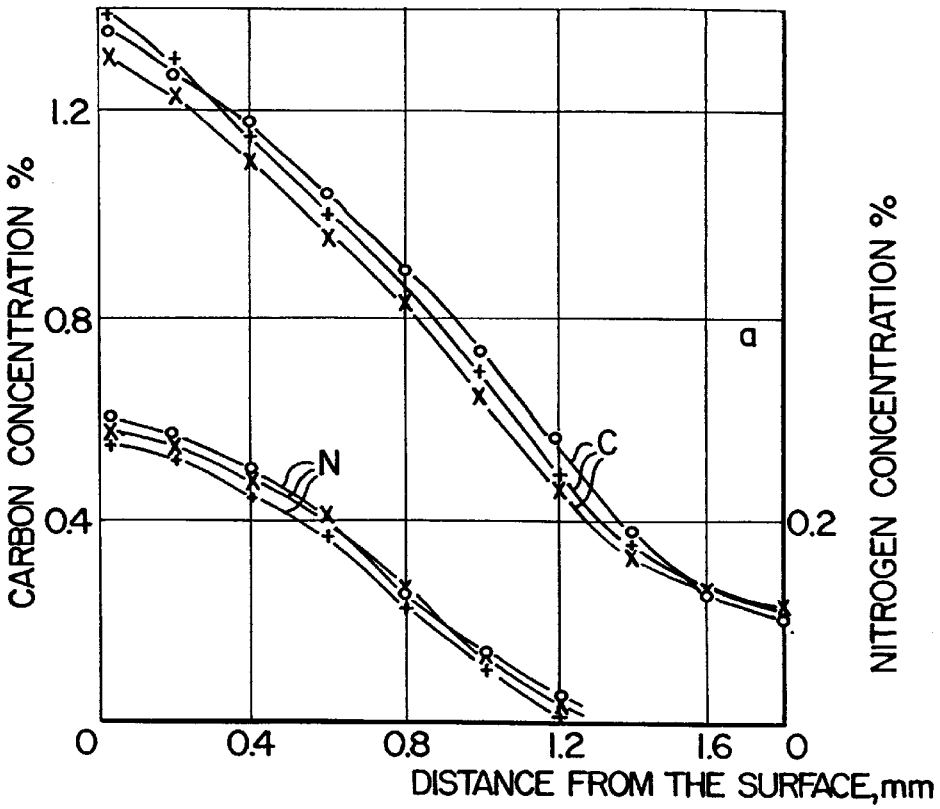
Figure 6B:
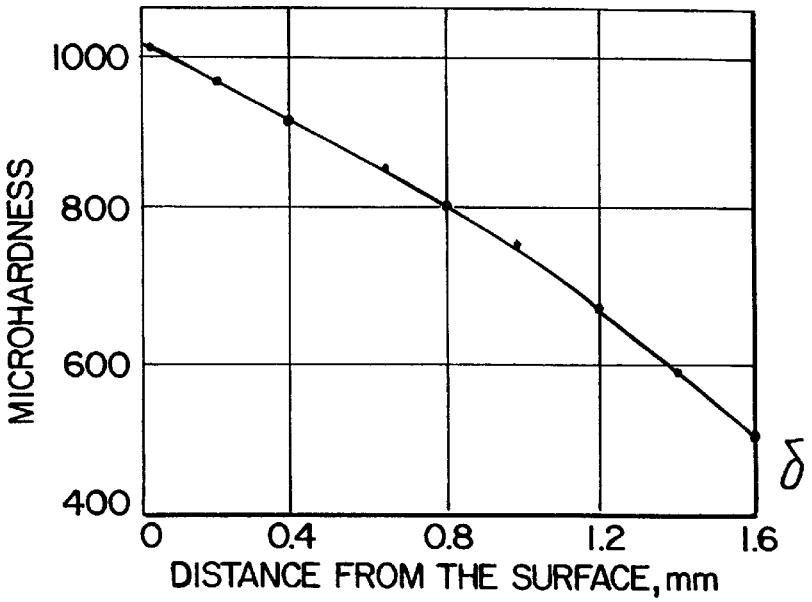

Results of saturation of machine parts made of complex-alloyed steel after ion nitrocarburizing with monitoring both carburizing and nitriding abilities of the atmosphere according to the applied method and the universal version of the device are shown on the FIGS. 6A and 6B.

Practical realization of the device may vary in accordance with the functions it is designed for.

The device includes the instrument transducer 1 connected through the electric signal converter 2 to the function generator 3 (FIG. 1).

In the device modification designed to determine one of the parameters—carburizing or nitriding ability of the ionized atmosphere during carburizing, nitrocarburizing or nitriding, or the beginning moment of excessive phase (soot carbon, carbides, nitrocarbides) formation during carburizing or nitrocarburizing—the instrument transducer is made as a module for filtering electromagnetic radiation consisting of the rotating disc 4 with two filtering elements 5, one of which corresponds to the primary standard frequency region, and the electromagnetic radiation receiver 6 (FIG. 2). The function generator 3 in that case includes successively connected the logarithmic amplifier 11, the module for detecting an amplitude-modulated signal component 12, the demodulator—converter 13 and the indicator 14. The logarithmic amplifier 11 input is made so as to provide possibility for its connection to the output of the electric signal converter 2.

Figure 3:
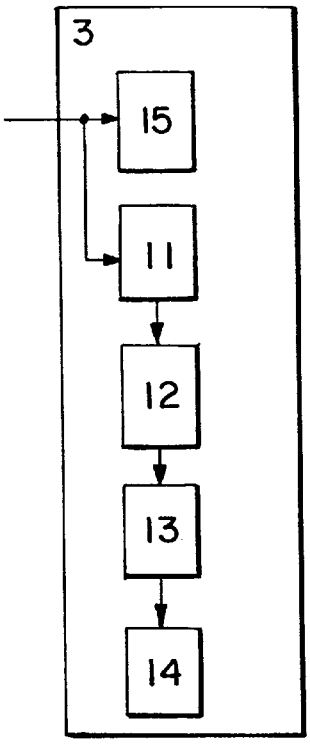

To detect the moment when an electric signal value excesses the tolerant limits defined by the sensibility of the electromagnetic radiation receiver, the function generator 3 is provided with the emergency signal module 15. The emergency signal module 15 input is made to provide possibility to connect it to the output of the electric signal converter 2 and to the input of the logarithmic amplifier 11 (FIG. 3).

THE BEST VERSION OF THE INVENTED DEVICE

The universal version of the device is designed for determination in arbitrary combination carburizing and nitriding abilities of the ionized atmosphere in carburizing, nitrocarburizing or nitriding, and the beginning moment of excessive phase (soot carbon, carbides, nitrocarbides) formation during carburizing or nitrocarburizing. In that case the instrument transducer includes the rotating disc 4 with several filtering elements 5 fixed radially in it (one of which corresponds to the primary standard frequency region) and the electromagnetic radiation receiver 6. The number of filtering elements 5 is equal to the number of accomplished functions.

To increase accuracy of filtering elements positioning in the region of electromagnetic radiation and in front of the electromagnetic radiation receiver, the filtering module for extracting electromagnetic radiation includes the disc rotating driver 7, the filtering elements positioning module, made as the filtering element position sensor 8, the synchronizer 9 and the program module 10 connected in sequence. The output of the program module is connected to the disk rotating driver (FIG. 2). The function generator 3 includes the memory module 16. A signal from the output of the electric signal converter 2 comes to the information input of the memory module 16 and a signal from the synchronizer 9 output comes to the control input of the memory module 16.

The division module 17 input is connected to the electric signal converter 2 output.

A signal from the division module 17 output comes to the indicator 14. A signal from the synchronizer 9 output also comes to the indicator 14 for additional synchronization of indicator operations.

Figure 4:
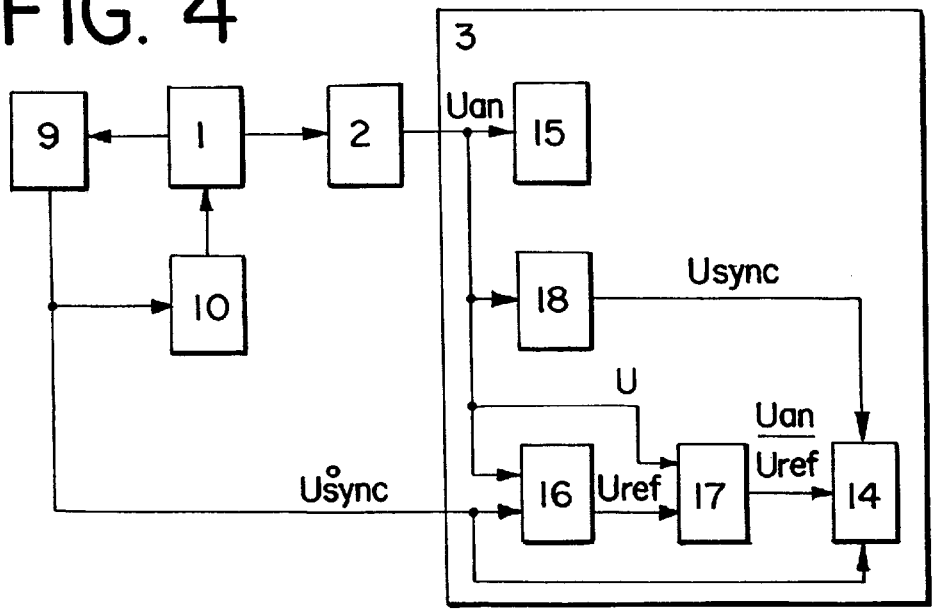

For additional more subtle synchronization the device is provided with the synchronizing pulse generator 18 which input is connected to the output of the electric signal converter 2. The emergency signal module 15 fulfills the same function as it does in the first version of the device (FIG. 4).

The device for implementation of the diagnostics method for heat treatment of steels and alloys in glow discharge operates in the following way. The instrumental transducer 1 is placed on the working chamber watching window of the ion heat treatment installation and is directed to the treated parts. Glowing discharge surrounding the treated parts surface forms electromagnetic radiation which comes to the rotating disc 4 with the filtering elements 5 fixed in radially it. Radiation in the frequency intervals extracted by the filtering elements 5 comes to the electromagnetic radiation receiver 6. One of the filtering elements 5 extracts radiation in the primary frequency standard and the second one extracts radiation in the analytical frequency region which is necessary to carry out one of the device functions, that is to monitor carburizing or nitriding atmosphere ability or to detect the moment of excessive phase formation.

The program module 10 provides rotation of the disc rotating driver 7 in such a manner that the rotating disc 4 with the filtering elements 5 stops for some time $t_s$ when one of the filtering elements 5 is in front of the electromagnetic radiation receiver 6 (FIG. 5). A rotation speed is chosen to provide filter alternation time $t_a$ to be much less than $t_s$. To increase rotating disc 4 positioning accuracy the program module 10 is additional synchronized with pulses generated by the synchronizer 9 according to signals of the filtering elements position sensor 8, when one of the filtering elements 5 is in front of the electromagnetic radiation receiver 6. The synchronizer 9 generates one pulse per one revolution of the rotating disc 4. As a result, radiation fluxes which come through the filtering elements 5 achieve alternately the electromagnetic radiation receiver 6. The output signal from the electromagnetic radiation receiver 6 comes to the electric signal converter 2, on which output a pulsing rectangular signal appears. The minimal and the maximal values $U_{min}$ and $u_{max}$ of this signal are defined by an electromagnetic radiation intensity in the frequency intervals extracted by the filtering elements 5 out of the glowing discharge specter. The minimal signal value corresponds to the reference signal in the primary frequency standard region:

$$U_{st}=U_{min}\sim I_{st}$$

$$U_{an}=U_{max}\sim I_{an}$$

here $I_{st}$, $I_{an}$ are the electromagnetic radiation intensities in the primary standard and analytical intervals.

The pulsing rectangular signal $U_{an}$ from the output of the electric signal converter 2 comes (in the first version of the device—FIG. 3) to the input of the logarithmic amplifier 11. After transformation in the logarithmic amplifier a pulsing rectangular signal appears on its output. The minimal and the maximal values of the last signal $U_{min}$ and $U_{max}$ are proportional to the logarithm of the electromagnetic radiation intensities in the primary standard and analytical intervals:

$$U_{min}{}^{1a}\sim \ln I_{st}$$

$$U_{max}{}^{1a}\sim \ln I_{an}$$

The amplitude-modulated signal component $U_{max}{}^{1a}-U_{min}{}^{1a}$ extracted by the module for detecting an amplitude-modulated signal component 12 comes to the demodulator—converter 13 input where it is transformed into a direct current signal with a value proportional to the quotient from division of the radiation intensity values in the two frequency intervals and equal to the quotient from division of the analytical signal and the reference signal. The demodulator output signal $$U_{dm}=\exp(\ln I_{an}-\ln I_{st})=I_{an}/I_{st}$$

comes to the indicator 14 where it represents a carburizing or nitriding ability value of the ionized atmosphere or induces a signal at a moment of appearance of an excessive phase when this value achieves the given threshold value $U_{tr}^1$ or $U_{tr}^2$, one of which detects the moment of appearance of the carbide (nitrocarbide) phase and the other detects the beginning moment of soot deposition.

The "low" and "high" signals are produced by the emergency signal module 15 when the minimal or the maximal values of the pulse signal at the output of the electric signal converter 2 are correspondingly less or more than the tolerances ($U_{low}$, $U_{high}$) defined by electromagnetic radiation receiver sensibility.

The universal version of the diagnostics device for heat treatment of steels and alloys in glow discharge operates in the following way. The instrumental transducer 1 includes several filtering elements 5 fixed in the rotating disc 4 and the filtering element position sensor 8 (FIG. 2). One of the filtering elements 5 is designed to extract the reference signal $U_{ref}$ corresponding to the primary standard frequency interval and the other filtering elements are designed to extract electromagnetic radiation in the analytical intervals according to the number of accomplished functions: to determine carburizing or nitriding ability of the ionized atmosphere, to detect the moment of excessive carbide (nitrocarbide) phase formation and the beginning moment of soot deposition. The filtering element position sensor 8 is fixed close to the rotating disc 4 in such a way that the sensor 8 generates a signal $U_{sync}$ only when one of the filtering elements 5 corresponding to the primary standard frequency interval is in front of the electromagnetic receiver 6.

The electric signal converter 2 transforms the output signal from the electromagnetic radiation receiver 6 into a complex rectangular signal. Its instant value $U_{an}$ at any time is defined by the electromagnetic radiation intensity in one of the frequency intervals extracted by the filtering elements 5 out of the glow discharge radiation specter.

The output signal from the electric signal converter 2 comes to the function generator 3 where it is treated according to the algorithm inherent in its structure.

The memory module 16 stores the output signal value U of the electric signal converter 2 at the moment when the synchronizing pulse $U_{sync}^o$ comes from the synchronizer 9. Since the synchronizer 9 produces that pulse only when the filtering element 5 of the primary standard frequency interval is in front of the electromagnetic radiation receiver 6, the memory module 16 stores the reference signal value $U_{ref}$ ($U=U_{ref}$).

The division module 17 divides the signal which has come from the electric signal converter 2 $U_{an}$ by the reference signal $U_{ref}$ stored in the memory module 16.

As a result, at the output of the division module 17 a complex rectangular signal appears, an instant value of which at any time is defined by the quotient from division of the signal proportional to the electromagnetic radiation intensity in one of analytical frequency intervals by the reference signal: $U_{an}/U_{ref}$. Instant signal values characterize both carburizing and nitriding abilities of the atmosphere and the phase transformations on the surface being saturated.

The output signal of the division module comes to the indicator 14 where it displays carburizing and nitriding abilities of the ionized atmosphere and induces another signals at the moments of the excessive phase formation when it achieves the threshold values of $U_{thr}^1$ or $U_{thr}^2$.

For synchronous displaying of the measured parameters the indicator 14 is synchronized with synchronizing pulses produced by the synchronizer 9 $U_{sync}^o$ and synchronizing pulse generator 18 $U_{sync}$, which both together transform the output signal of the electric signal converter 2 into a pulse series going with the rate of the filtering elements 5 alternation in front of the electromagnetic radiation receiver 6.

The emergency signal module 15 operates as in the first device modification.

Practical implementation of the applied invention due to its advantages in accuracy of the heat treatment diagnostics simplifies technological cycles design and makes it possible to decrease a spread in values of carbon and nitrogen concentration along a diffuse layer depth which is confirmed by the series of examples.

In particular, the diagnostics method of heat treatment in glow discharge is suitable for steels of various composition including both low-alloyed steels which can be treated in away preventing excessive carbide or nitrocarbide phase formation in the diffuse layer and complex-alloyed steels which diffuse saturation is accomplished with formation of a highly developed two-phase zone providing high fatigue resistance for treated parts.

Low-alloyed parts were treated in a way preventing development of an excessive nitrocarbide phase with the following goal characteristics: the case depth of 1.0 mm, the surface concentration of carbon—0.8%, of nitrogen—0.2%. The treatment was done on the experimental industrial installation provided with an automated control system including a microprocessor and the diagnostics device for heat treatment in glow discharge.

The device sensor fixed on the working chamber watching window included the module for filtering electromagnetic radiation and was made as a rotating disc with five filtering elements fixed in it. One of the filtering elements extracted electromagnetic radiation proportional to a quantity of carbon-containing active components of the ionized atmosphere; the second filtering element extracted radiation proportional to a quantity of nitrogen-containing active components of the ionized atmosphere; the third one extracted radiation of the active particles of the metal being saturated. When the last mentioned radiation achieved some given threshold value, the beginning moment of carbonitride phase formation on the treated surface was detected.

The forth filtering element was designed for extracting radiation of the active particles of soot carbon; this measurement was used for detecting the beginning moment of soot deposition.

The fifth filtering element extracted electromagnetic radiation of a total number of particles of the ionized atmosphere.

An electric signal corresponding to extracted electromagnetic radiation in the given frequency intervals came to the function generator and then to the microprocessor which produced control signals for a final control system manipulating the atmosphere components expenditure. The system also controlled working temperature and pressure.

To achieve the ordered parameters of a niotrocarburized layer, two levels (top and bottom) were set for atmosphere carburizing ability and two threshold signal values, one of which was used to detect the beginning moment of the carbonitride phase formation and the other witnessed the beginning of soot deposition.

The treated parts placed on the cathode were heated in vacuum up to the temperature of 900+5 C. After isothermal soaking for 20 minutes components of the technological atmosphere $C_2H_2$, $NH_3$, and Ar were introduced into the working chamber through three pipe-lines. (Ar was used as a solvent gas.) Then glowing discharge was ignited which added extra heat to the parts within the limits of 10 C. The diffuse layer was formed in a pulse carbon-feeding cycle when hydrocarbon boost steps were alternated by diffusion steps levelling down a carbon concentration in steel.

During the boost step carburizing ability of the atmosphere was kept on the high level until the moment of nitrocarbide phase formation on the metal surface had come, then it was switched automatically to the low level and was kept there for another 20 minutes. During this step carbon concentration in steel levelled down and nitrocarbides dissolved. After these 20 minutes atmosphere activity was again automatically increased to the high level where it was kept until the signal generated by the third filtering element had achieved the threshold value and then the whole cycle was repeated. During all treatment time the signal detecting the soot deposition moment was less then the threshold value and that was the evidence of high treatment quality.

As a result of insufficiently effective diagnostics according to the prototype method an excessive nitrocarbide phase could develop in the diffuse layer with the volume share of 15%.

Layer characteristics compared to those achieved according to the prototype diagnostics method are represented in the table.

TABLE

| | Diffuse layer characteristics | | | Exploitation properties | | |
|---|---|---|---|---|---|---|
| Diagnostics | Surf. Concentr. | | Case depth | Surface hardness | Contact fatigue load resist., | Max limit |
| Method | C % | N % | mm | HRC | *10- cycles | MPa |
| Applied | 0.8 | 0.2 | 0.8 | 60 | 43.74 | 830 |
| Prototype | 0.16 | 0.15 | 0.95 | 63 | 27.53 | 650 |

Risk of soot deposition increases to the end of treatment of complex-alloyed steels liable to intensive carbon formation in the surface layer. That fact increases necessity of detection of the beginning moment of soot deposition.

Exploitation of the applied method made it possible to detect the beginning moment of soot carbon deposition on the surface of a complex-alloyed steel at 100-th minute since the treatment start. A diffuse layer with ordered characteristics was achieved due to carburizing ability control.

When parts made of the same steel were treated using the prototype diagnostics method no soot deposition was detected although the treated parts were all covered with soot carbon. Diffuse layer characteristics and exploitation properties proved to be unsatisfactory.

Results of ion nitrocarburizing of a complex-alloyed steel are presented in the FIG. 6. They show high stability and reliability of the applied diagnostics method and confirm possibility to reproduce the ordered diffuse layer characteristics many times when the applied method and the device are used.

THE FORMULA OF THE INVENTION

We claim:

1. A method of carrying out diagnostics on a process for the thermo-chemical treatment of steels and alloys in glow discharge by monitoring characteristics of an ionized atmosphere and subsequently estimating process parameters comprising the steps of:

monitoring ionized atmosphere characteristics by extracting electromagnetic radiation in particular frequency intervals corresponding to active components and to a total number of ionized atmosphere particles;

converting an intensity of the extracted electromagnetic radiation into corresponding electric signals; and, estimating process parameters according to a quantity of active components of the ionized atmosphere, the quantity of active components derived by comparing the electric signals with one of the electric signals chosen as a reference signal and corresponding to a radiation intensity from a total number of particles of the ionized atmosphere.

2. The method according to claim 1 wherein the step of comparing the electric signals produced by conversion of the intensity of the extracted electromagnetic radiation with the reference signal comprises dividing each of the electric signals by the reference signal.

3. The method according to claim 1, wherein carbon containing particles are used as active components of the ionized atmosphere when extracting electromagnetic radiation, and a carburizing ability of the ionized atmosphere is estimated in correspondence with a quantity of the carbon containing particles.

4. The method according to claim 1, wherein nitrogen-containing particles are used as active components of the ionized atmosphere when extracting electromagnetic radiation, and a nitriding ability of the ionized atmosphere is estimated in correspondence with a quantity of the nitrogen containing particles.

5. The method according to claim 1, wherein particles of a metal being saturated are used as active components of the ionized atmosphere when extracting electromagnetic radiation and a moment of formation of an excessive carbide (nitrocarbide) phase on a treated surface of steels and alloys is detected when a quantity of the particles of the metal being saturated achieves a given threshold value.

6. The method according to claim 1, wherein particles of soot carbon are used as active components of the ionized atmosphere when extracting electromagnetic radiation, and a moment of soot deposition on a metal surface is detected when a quantity of the soot carbon particles achieves a given threshold value.

7. The method according to claim 1, wherein boundary values of particular frequency intervals of electromagnetic radiation characterizing a state of the ionized atmosphere are set up as constant.

8. The method according to claim 1, wherein boundary values of particular frequency intervals of electromagnetic radiation characterizing a state of the ionized atmosphere are defined during a diagnostics process.

9. A device for diagnostics of heat treatment of steels and alloys in glow discharge comprising: an instrumental transducer connected through an electric signal converter to a function generator, wherein the instrumental transducer is designed as a filtering module to extract electromagnetic radiation both from active components and from a total number of particles of an ionized atmosphere, the filtering module comprising a set of filtering elements which can be positioned one after another in a region of electromagnetic radiation being received in front of an electromagnetic radiation receiver.

10. The device according to claim 9, wherein the function generator comprises a logarithmic amplifier, a module for detecting an amplitude-modulated signal component, a demodulator-converter, an indicator and also an emergency signal module connected one after another, and wherein an input of the emergency signal module and an input of the logarithmic amplifier designed to be connected to an output of the electric signal converter are connected to each other.

11. The device according to claim 9, wherein the filtering module comprises:

a rotating disc with filtering elements fixed radially in it, a disc rotating driver and a filtering elements positioning module, wherein the filtering module is designed to extract electromagnetic radiation both from active components and from a total number of particles of the ionized atmosphere;

the filtering elements positioning module comprising a filtering element position sensor, a synchronizer and a program module connected successively; and, wherein an output of the program module is connected to the disc rotating driver.

12. The device according to claim 9, further comprising:

a filtering elements positioning module and a program module;

the function generator configured as a memory module, a division module and an indicator connected one after another, and also the synchronizing pulse generator and an emergency signal module;

an input of the emergency signal module, the synchronizing pulse generator, an information input of the memory module, and a dividend input of the division module are connected to an output of the electric signal converter;

a control input of the memory module is connected to an output of the positioning module, which is connected through the program module to the filtering module designed to extract electromagnetic radiation from active components and from a total number of particles of the ionized atmosphere; and wherein inputs of the indicator are connected correspondingly to the control input of the memory module and an output of the synchronizing pulse generator.

* * * * *

UNITED STATES PATENT AND TRADEMARK OFFICE

CERTIFICATE OF CORRECTION

PATENT NO. : 5,846,341

DATED : December 8, 1998

INVENTOR(S) : Shemetov et al.

It is certified that error appears in the above-indentified patent and that said Letters Patent is hereby corrected as shown below:

On the Title Page

In column 1, [item] 76, please change: "Odintsovskil" to --Odintsovskij--; "Moskovskava" to --Moskovskaya--; "Stavropplskava" to --Stavropolskaya--; "Shorematyevaskaya" to --Sheremetyevskaya--.

In column 1, line 1, under "U.S. PATENT DOCUMENTS", please change "L'ttermite" to --L'hermite--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*